United States Patent [19]

Renger et al.

[11] Patent Number: 4,579,543

[45] Date of Patent: Apr. 1, 1986

[54] ANIMATED FIGURE TOY HAVING PLURAL HEADS AND MOVEABLE ARMS

[75] Inventors: Larry H. Renger, Hawaiian Gardens; Roger H. Sweet, Lon Beach, both of Calif.

[73] Assignee: Mattel, Inc., Hawthorne, Calif.

[21] Appl. No.: 685,669

[22] Filed: Dec. 24, 1984

[51] Int. Cl.[4] ..... A63H 13/06

[52] U.S. Cl. ..... 446/334; 446/379

[58] Field of Search ..... 446/376, 379, 380, 381, 446/383, 330, 334, 336, 297, 335, 317, 354, 352, 357, 333

[56] References Cited

U.S. PATENT DOCUMENTS

| | | | |
|---|---|---|---|
| 2,208,487 | 7/1940 | Amerise | 446/297 |
| 2,279,603 | 4/1942 | Wallis | 446/336 X |
| 3,234,689 | 2/1966 | Ryan | 446/380 |
| 3,377,740 | 4/1968 | Bonanno et al. | 46/119 |
| 3,425,153 | 2/1969 | Bonanno et al. | 46/119 |
| 3,452,472 | 7/1969 | Meyer et al. | 46/119 |
| 3,750,330 | 8/1973 | Smith, III et al. | 446/330 |
| 4,003,158 | 1/1977 | Wolf et al. | 46/120 |

*Primary Examiner*—Mickey Yu

*Attorney, Agent, or Firm*—Ronald M. Goldman; Melvin A. Klein

[57] ABSTRACT

An animated figure toy (10) includes an upper torso (14) provided with a pair of heads (18, 19) and a pair of arms (20, 21) rotatably fixed to shoulder portions (24, 26) by spring assembly (27, 28). The arms may be pulled back and released so as to strike the head on the opposite side of the upper torso. A lower torso (16) is rotatably mounted on the upper torso by means of a boss (76) coupling the torsos together for relative rotation, and includes legs (22, 23) rotatably mounted therein, and held together by a single connector (29).

7 Claims, 3 Drawing Figures

ANIMATED FIGURE TOY HAVING PLURAL HEADS AND MOVEABLE ARMS

DESCRIPTION

1. Technical Field

The present invention relates to animated figure toys, and more particularly to a new and useful animated figure toy having moveable arms which may be used to strike one or more heads.

2. Background Art

U.S. Pat. No. 3,377,740 discloses an animated doll which has moveable arms which may be rotated downwardly, latched in position, and released by pressing on the body of the doll.

U.S. Pat. No. 3,425,153, discloses an animated doll in which the arms are mounted on a rotatable spindle, which may be actuated to one position where it is latched, and released by pressing a trigger in the doll.

U.S. Pat. No 3,452,472, discloses a doll having a spring biased arm which is manually twisted in one direction and released to effect quick movement of the arm in the opposite direction.

U.S. Pat. No. 4,003,158, discloses an animated toy doll having a pair of arms. Actuating means in the doll pivots the torso of the doll and simultaneously swings one arm upward and the other arm downward, in a simulated fighting motion.

None of the above identified patents disclose the specific, animated figure toy of the present invention having plural heads and moveable arms which may be selectively operated to strike one of the heads.

DISCLOSURE OF THE INVENTION

In accordance with the present invention, a new and useful animated figure toy is provided with an upper torso, a lower torso and means rotatably connecting the torsos together. The upper torso includes a plurality of rotatable limbs and a plurality of heads and at least one of the limbs may be activated to strike one of the heads.

BRIEF DESCRIPTION OF THE DRAWINGS

Details of the present invention will be described in connection with the accompanying drawings wherein.

BEST MODE FOR CARRYING OUT THE INVENTION

Figure 1:
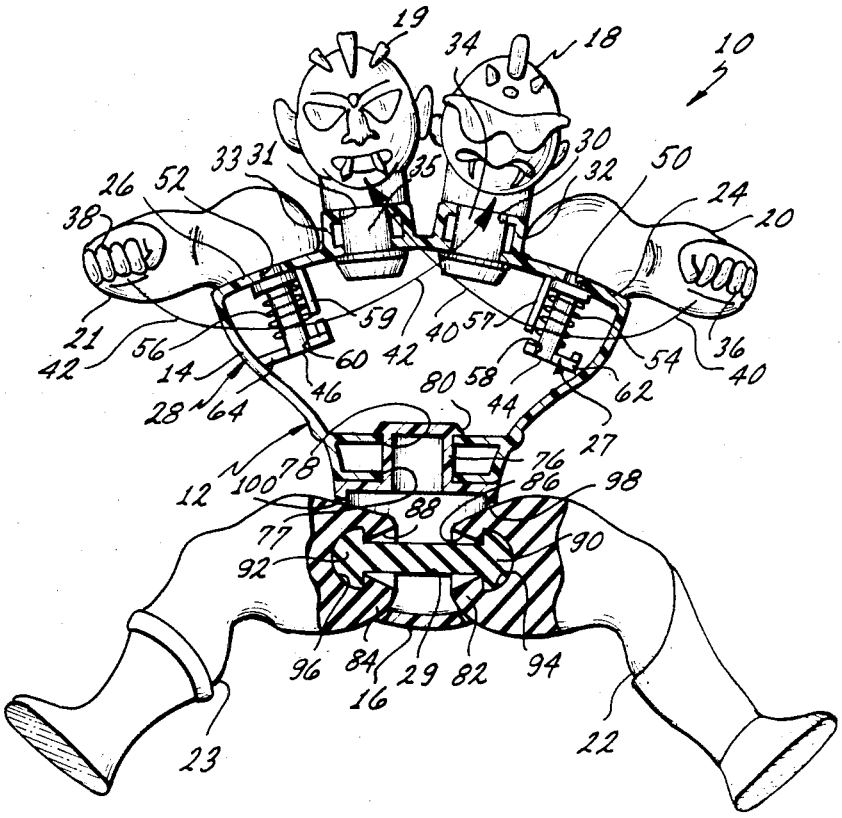
FIG. 1 is a front elevational view, with portions broken away, of an animated figure toy consisting of a presently preferred embodiment of the invention.

Referring now to the drawings, a figure toy constituting a presently preferred embodiment of the invention is generally designated 10. The figure toy includes a hollow body 12 comprising a hollow upper torso 14 and a hollow lower torso 16, which may be rotated with respect to each other.

Figure toy 10 also includes a plurality of rotatable hollow heads 18, 19, and various limbs or appendages, such as arms 20, 21, and legs 22, 23. The arms are rotatably mounted at predetermined angles and in specific positions on upper torso 14, adjacent shoulder portions 24, 26, by spring assemblies or other means 27, 28. Legs 20, 21 may be attached to the lower torso 16 in any convenient manner, and may be held together by a connector or fastener means 29.

Figure 3:
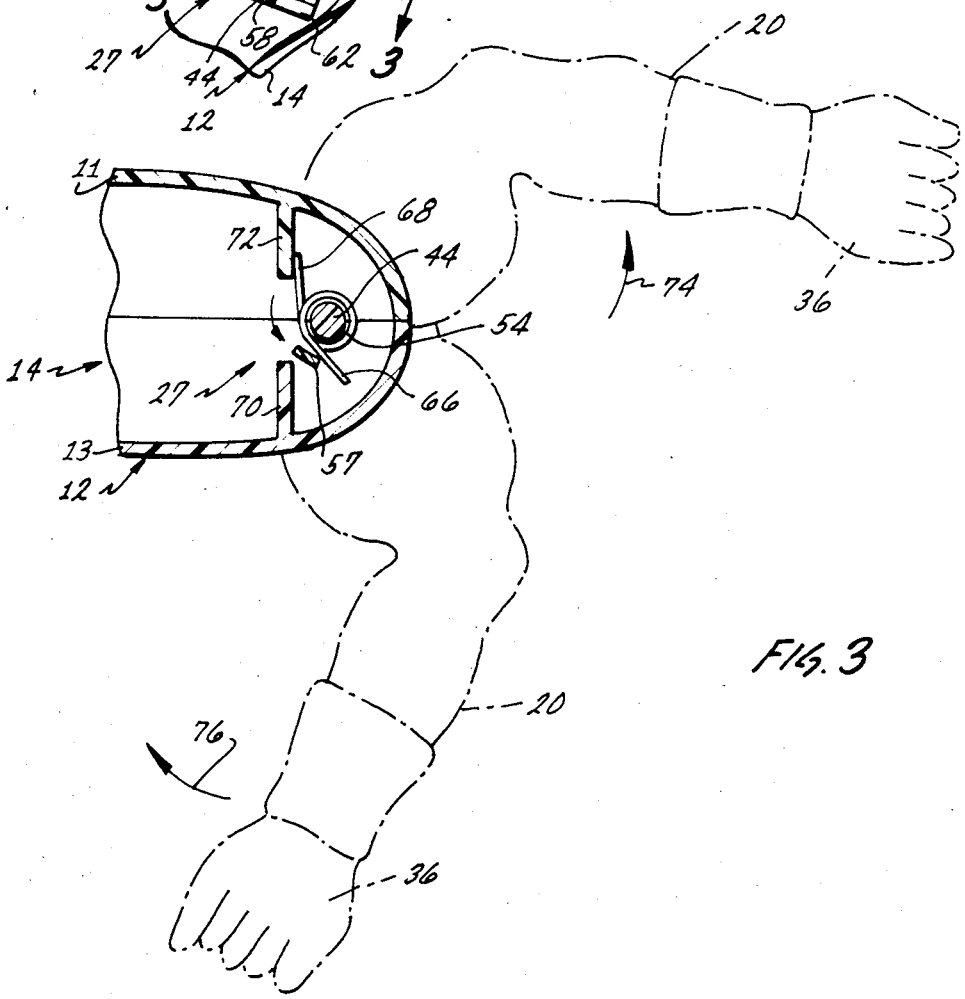
FIG. 3 is an enlarged partial sectional view, taken along line 3—3 of FIG. 2.

As best shown shown in FIG. 3, the upper torso 14 is formed from two halves 11, 13, which may be made from molded plastic material. The top portion of the upper torso 14, between the shoulder portions 24, 26, includes a plurality of neck openings 30, 31, passing through necks 32, 33 formed integrally with or attached to the upper torso. The heads 18, 19 are captured or journaled for rotational movement within the necks 32, 33, by means of neck plugs 34, 35, attached to or formed integrally with the heads.

The heads 18, 19 the upper torso 14, and the lower torso 16 may be molded from suitable polymeric material, and are held together by conventional pin and socket type connectors, or in any other suitable manner.

The arms 20, 21, are mounted to the shoulder portions 24, 26 of the upper torso 14, in such a manner that they may each be moved or pulled back toward the rear torso half 11 from a resting position, and then released. Upon release, the spring assemblies 27, 28 operate the arms so as to punch or strike the head on the opposite side of the body, as explained more fully hereinafter.

The shoulder portions 24, 26, of the upper torso 14 are formed or sculpted of a predetermined size, at predetermined angles to the torso 14, and in specific relationship to the necks 32, 33. In addition the arms 20, 21 are formed of a size and shape, that when the arms 20, 21 are mounted on the shoulders, hand or fist portions 36, 38 at the ends thereof may be pulled back to load the spring assemblies, and released by a child user so as to contact or strike the head mounted adjacent the opposite shoulder. That is, when arm 20 is released, after being pulled back, it will rotate in the direction of the arrow 40 (FIG. 1) until the hand or fist 36 contacts or strikes head 19, adjacent the opposite shoulder 26, at the end of its travel. Also, when arm 21 moves on shoulder 26, in the direction of arrow 42, hand 38 will contact or strike head 18, at the end of its travel.

Figure 2:
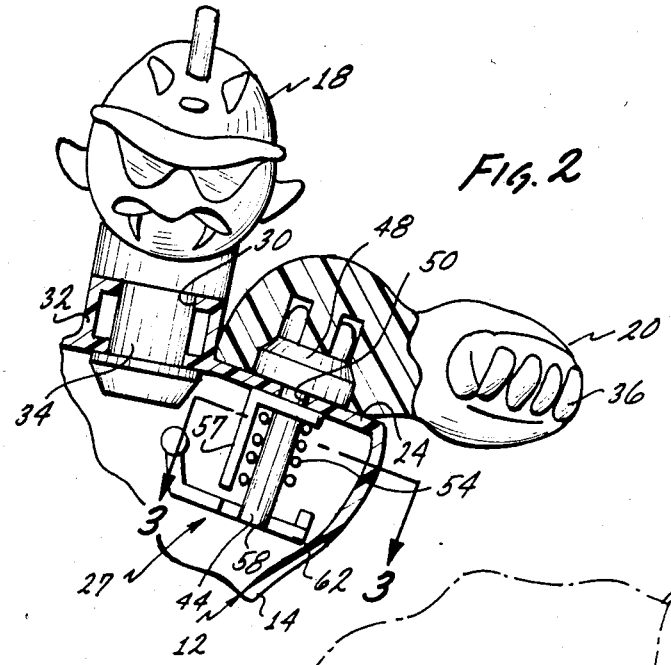
FIG. 2 is an enlarged partial view showing one of the heads, one of the arms and their attachment to the upper torso of FIG. 1.

Each of the arms is shown in FIGS. 1 and 2 in its resting position on its respective shoulder. Upon rotation of each arm from this position, the spring assemblies 27, 28 will be loaded. The spring assemblies include shafts 44, 46 attached to the arms 20, 21 by means of arm connectors, such as 48 (FIG. 2). The shafts extend through openings 50, 52 formed in the shoulder portions into the hollow interior of the upper torso. Spring means 54, 56, such as a torsion spring, surrounds each of the shafts 44, 46 and is held thereon between the shaft and a wall portion, such as 57, 59. The inner end of each shaft is rotatably journaled or held in an opening 58, 60 formed within further walls 62, 64 held or formed in the upper torso. Extending ends of the spring means, two of which, 66, 68 are shown in FIG. 3, are adapted to engage stop means, such as still further walls 70, 72, fixed to or formed integrally in the front and rear halves of the upper torso.

It therefore can be seen, that each arm, such as arm 20 shown in broken line in FIG. 3, may be pulled back toward the rear half 11 of figure toy 10, in the direction of arrow 74. As the arm is pulled back by the user, end 68 of torsion spring 54 will first contact wall 72. The arm may then be pulled back still further thereby loading spring 54. Arm 20 is then released and is rotated or turned by spring 54, in the direction of arrow 76, FIG. 3, or arrow 40 in FIG. 1, until it contacts or strikes the opposite head, i.e., head 19. As the arm 20 rotates in the direction of arrow 40 or 76, the end 66 of spring 54 will rotate into contact with and be loaded in the opposite direction by the wall 70. This opposite loading of the spring provides a biasing force in the opposite direction to return the arm to its rest or unloaded position, after striking head 19.

Arm 21, mounted on shoulder 26 is operated in the same manner, i.e., first pulled back toward the rear half 11 from its resting position, and then released so as to rotate in the direction of arrow 42 until it strikes opposite head 18.

Lower torso 16 is rotatably connected to upper torso 14 by means of a cylindrical boss 76 formed integrally with the lower torso and extending upwardly, through openings 77, 78 formed in upper torso 14, and held therein by means of a lip 80. The lower torso 16, the boss 78, and the extending lip portion 80 fixed to or formed integrally with the boss may be molded from a suitable polymeric material. The legs 22, 23 are held in the lower torso 16, and are provided with inner ends 82, 84 have enlarged openings 86, 88 therein. Enlarged ends 90, 92 of the connector 29 pass through the openings 86, 88, and are captured within shaped chambers 94, 96 formed within the legs. The inner ends 82, 84 are shaped and sized so that they coact with openings 98, 100 in the lower torso 16, and at the same time move relative to the connector 29 via the funnel shaped or slanted openings 86, 88 so that the legs move in a realistic semblance of the action of a persons legs.

It therefore can be seen that a new and novel animated toy figure having a plurality of heads which may be played with by a child has been provided. The toy figure is provided with upper limbs or arms which may be actuated by the child user to simulate the striking of one or both of the heads, in the manner of dual type personality. That is, the arm on one side may be caused to strike the head on the other side, as if directed by the head adjacent the striking arm, and vice versa. In addition, the lower limbs or arms are connected and formed in such a manner as to give the appearance of the actual movement of a persons legs.

While the particular animated figure toy herein shown and described in detail is fully capable of attaining the objects and providing the advantages hereinbefore stated, it is to be understood that it is merely illustrative of the presently preferred embodiment of the invention, and that no limitations are intended by the details of construction or design herein shown and described, other than as defined in the appended claims.

The term "means", as employed in the claims is to be interpreted as defining the corresponding structure illustrated and described in the specification or equivalent thereof.

We claim:

1. An animated figure toy comprising in combination:

an upper torso having a front, a rear, a shoulder portion and a waist portion.

a lower torso connected to said upper torso at said waist portion;

a plurality of heads positioned in side-to-side relationship rotatably attached to said upper torso;

a plurality of limbs moveably attached to said upper and lower torsos, at least one of said limbs being an arm operably coupled to said upper torso and associated with one of said heads on the opposite side thereto; and activating means for operably coupling each of said at least one arm to said upper torso and allowing said each of said at least one arm to be moved in a predetermined path from a starting position to a loaded position and then upon release to move in said predetermined path to strike said associated one of said heads.

2. The animated figure toy of claim 1 wherein said upper torso has two heads and two arms attached thereto, and each of said activating means includes a spring assembly which normally keeps each of said arms at said starting position, said each of said arms loading said spring assembly when pulled back whereby upon release, said each of said arms will move in said predetermined path to strike only said associated one of said heads, and then be returned to said starting position by said spring assembly.

3. The animated figure toy of claim 2 wherein said two heads are mounted and spaced from each other by a predetermined distance and said two arms are mounted and spaced on both sides of said heads at such an angle and at another predetermined distance so that when said arms are pulled back and released, each of said arms will move in said predetermined path to strike one of said two heads adjacent to the other of said arms, and then return to said starting position.

4. An animated figure toy comprising in combination:

An upper torso having a front, a rear, a shoulder portion and a waist portion;

a lower torso connected to said upper torso at said waist portion;

a plurality of limbs moveably attached to said upper and lower torsos;

a plurality of heads rotatably attached to said upper torso;

wherein at least one of said limbs includes activating means for allowing said at least one of said limbs to be moved from a starting position to a loaded position and then be released to strike a selected one of said heads;

wherein said upper torso has two heads and two arms attached thereto, each of said arms including said activating means, said activating means including a spring assembly which normally keeps said each of said arms at said starting position, said each of said arms loading said spring assembly when pulled back whereby upon release, said each of said arms will strike only one of said two heads, and then be returned to said starting position by said spring assembly; and wherein said spring assembly includes a shaft fixed to said each of said arms and extending into said upper torso through said shoulder, and a torsion spring mounted around said shaft and adapted to be loaded so as to actuate said each of said arms toward said one of said two heads upon pulling said each of said arms, from said starting position toward the back of said figure toy, and releasing said each of said arms after said torsion spring is loaded.

5. The animated figure toy of claim 4 further including a pair of legs mounted in said lower torso, said pair of legs having inner and outer ends, said inner ends held in said lower torso and being rounded with funnel shaped openings formed therein together with chambers formed within each of said funnel shaped openings, and connector means in said lower torso captured between said legs in said chambers for allowing each of said legs to be separately moved with respect to said lower torso and said connector.

6. An animated figure toy comprising in combination:

an upper torso having a front and a rear with a pair of shoulder portions and a lower waist portion, and a pair of necks formed thereon between said shoulder portions;

a lower torso rotatably attached to said upper torso at said waist portion and having a pair of legs rotatably attached thereto;

a pair of arms rotatably attached to said upper torso on said shoulder portions; a spring assembly including shafts fixed to said arms and normally holding said arms in starting positions, said shafts extending into said upper torso through openings formed in said shoulders, and torsion springs mounted around said shafts and adapted to be loaded by rotation of said arms by a user from said starting positions toward loaded positions at the rear of said upper torso; and a pair of heads rotatably attached to said pair of necks formed on said upper torso, whereby upon release of each of said arms by a user from said loaded positions, each of said arms will rotate to strike the head adjacent to the opposite arm, and then return to its respective starting position.

7. The animated figure toy of claim 6 wherein said pair of legs include rounded inner ends which are held together by a single connector having enlarged ends captured in chambers formed in said rounded ends, said chambers having funnel shaped openings formed adjacent thereto through which said connector extends, whereby said legs may be moved with respect to said connector and said lower torso.

* * * * *